US005112187A

United States Patent [19]

Davids et al.

[11] Patent Number: 5,112,187

[45] Date of Patent: May 12, 1992

[54] EROSION CONTROL THROUGH REDUCTION OF MOISTURE TRANSPORT BY SECONDARY FLOW

[75] Inventors: Joseph Davids, Maitland; George J. Silvestri, Jr., Winter Park, both of Fla.

[73] Assignee: Westinghouse Electric Corp., Pittsburgh, Pa.

[21] Appl. No.: 747,406

[22] Filed: Aug. 19, 1991

Related U.S. Application Data

[63] Continuation of Ser. No. 580,993, Sep. 12, 1990.

[51] Int. Cl.[5] ..... F01D 25/32

[52] U.S. Cl. ..... 415/169.3; 415/914

[58] Field of Search ..... 415/168.1, 169.1, 169.2, 415/169.3, 169.4, 914

[56] References Cited

U.S. PATENT DOCUMENTS

| | | | |
|---|---|---|---|
| 3,014,640 | 12/1961 | Barney et al. | 415/169.1 |
| 3,193,185 | 7/1965 | Erwin et al. | 415/914 |
| 3,301,529 | 1/1967 | Wood | 415/169.3 |
| 3,973,870 | 8/1976 | Desai | 415/169.4 |
| 4,738,585 | 4/1988 | Bockh | 415/169.3 |

OTHER PUBLICATIONS

Thomas Vuksta, Jr.; "Tangential Blade Velocity and Secondary-Flow Field Effect on Steam-Turbine", Exhaust Blade Erosion; ASME pub.; Nov., 1963; pp. 1-8.

*Primary Examiner*—Edward K. Look
*Assistant Examiner*—Hoang Nguyen

[57] ABSTRACT

A steam turbine including a plurality of rows of rotating blades interspersed with a plurality of rows of stationary blades incorporates a water barrier extending substantially across a suction side of each blade of at least one of the rows of stationary blades. Each of the water barriers is positioned relatively near a radially outer end of a respective blade and approximately parallel to an end wall of the steam turbine. Moisture which accumulates on the radially outer end of the stationary blades is trapped between the end of the blade and the water barrier. Any water which attempts to flow over the top of the barrier is picked up by the steam flow and broken into small droplets while being rapidly accelerated. Water held behind the barrier and which flows off the trailing edge of the stationary blade only impacts a limited extent of the following rotating blade row. Water collection schemes may be utilized to collect the moisture trapped above the barrier and transfer the moisture through the turbine end wall to appropriate feedwater reheaters.

6 Claims, 2 Drawing Sheets

FIG. 3
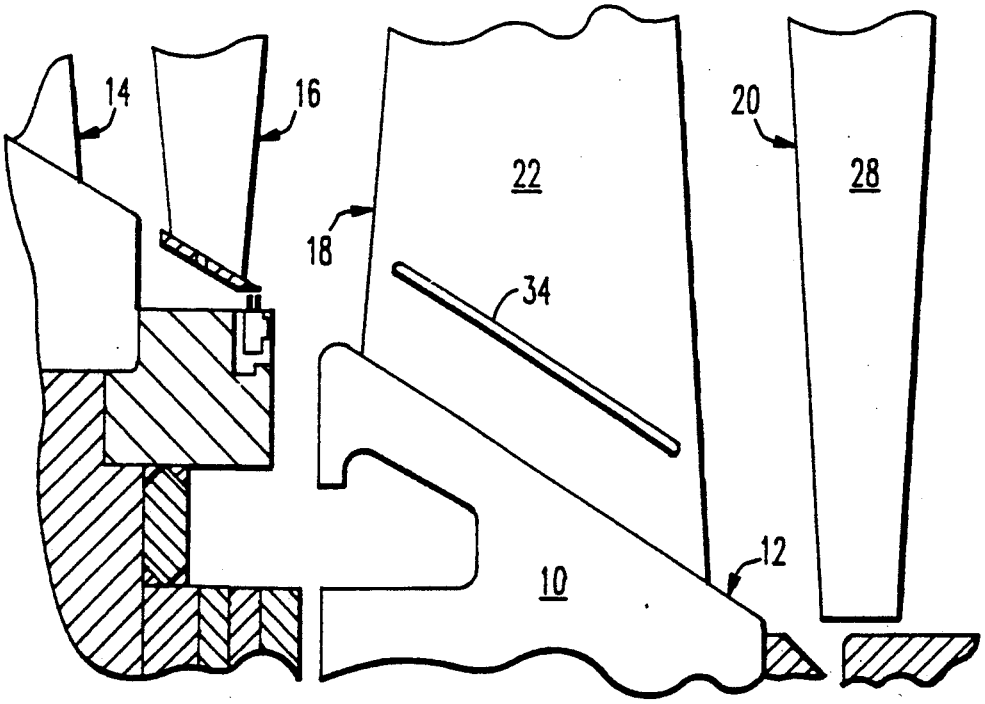
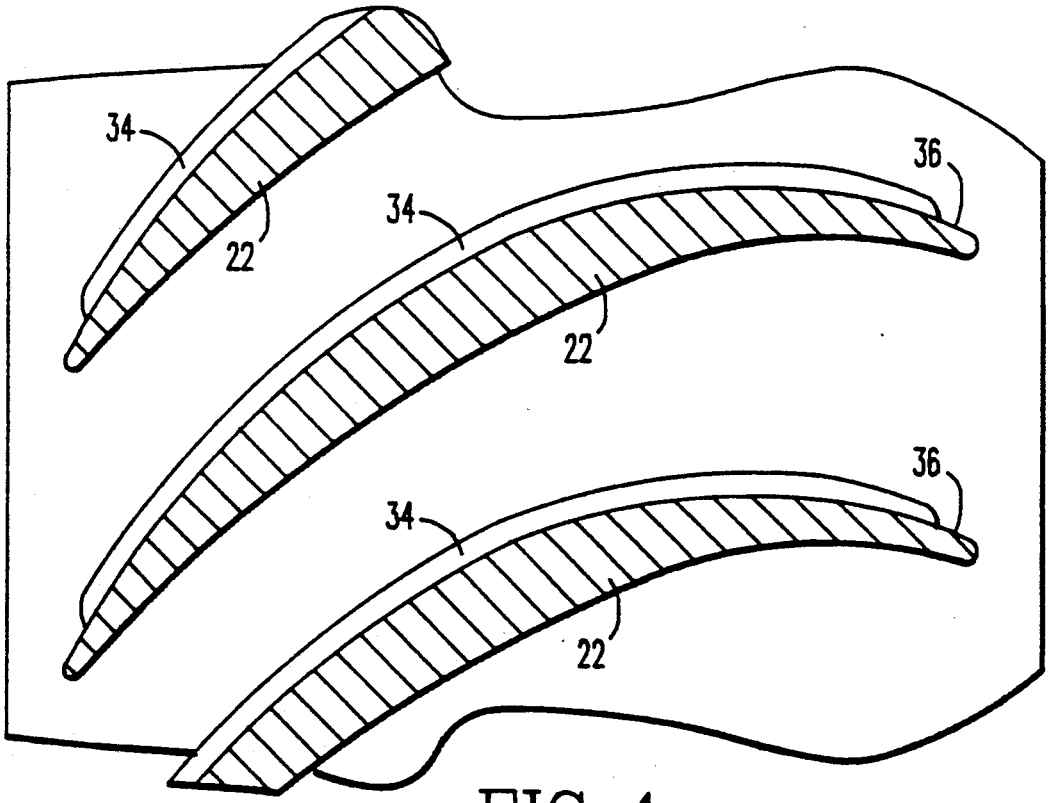
FIG. 4

EROSION CONTROL THROUGH REDUCTION OF MOISTURE TRANSPORT BY SECONDARY FLOW

This application is a continuation of application Ser. No. 07/580,993 filed Sep. 9, 1990.

The present invention relates to steam turbines and, more particularly, to a method and apparatus for reducing erosion of rotating blades caused by moisture precipitating from steam flowing through the turbine.

BACKGROUND OF THE INVENTION

Leading edge blade erosion in steam turbines is attributable to moisture droplets in the steam flow that impinge upon the blade leading edge. Various measures have been taken to reduce such blade erosion. For example, water catchers and drainage devices have been incorporated in turbine walls; baffles and drainage passages have been incorporated in stationary blades; and grooves, stelliting, and surface-hardening have been used on rotating blades. While various methods such as these have been successful in somewhat alleviating erosion, such erosion continues to be a problem in steam turbines.

A study conducted several years ago and reported in ASME Paper No. 63-WA-238 entitled "Tangential Blade Velocity and Secondary Flow Field Effect on Steam-Turbine, Exhaust-Blade Erosion", published November, 1963, describes the secondary flow field effect and how it contributes to moisture transport in the steam flow. Secondary flow in a cylinder blade row (stationary blades) is generated by the static pressure gradient along the end wall which confines the main steam flow field within the boundaries of the suction and pressure surfaces of adjacent blades. The static pressure gradient imposed upon the end wall boundary layer fluid causes the boundary layer to flow along the end wall from the pressure side of one blade to the suction side of an adjacent blade. The secondary flow pattern on the blade suction side has a radially inward component tending to spread the accumulated moisture along the trailing edge of the blade. The radially inward depth of the secondary flow varies with end wall shape. For a cylindrical end wall, the depth is between about 10% and 15% of blade length while for an S-shaped end wall, the depth may be as high as 25% of blade length. The blade erosion pattern on rotating blades immediately downstream of the cylinder blades correlates with the depth of secondary flow.

Cylinder blade pitch also affects secondary flow and the depth of erosion on rotating blades. Increasing pitch produces a concomitant increase in secondary flow. When cylinder blades are pitched properly, secondary flow is primarily axial in orientation and erosion depth on rotating blades is reduced. Overpitched cylinder blades result in a secondary flow with a significant radially inward component resulting in increased depth of erosion. However, even with properly pitched blade and axial secondary flow, moisture will accumulate at a significant radial distance from the rotating blade tip because of the radially outward divergence of the end wall of the stationary blades.

SUMMARY OF THE INVENTION

It is an object of the present invention to provide a method and apparatus for reducing rotating blade edge erosion from moisture transported by secondary flow by limiting the extent of moisture migration along suction surfaces of stationary blades.

The above and other objects are achieved in a steam turbine system including a plurality of rows of rotating blades interspersed with a plurality of rows of stationary blades in which at least one of the rows of stationary blades incorporates a water barrier extending substantially across a suction side of each blade. Each of the water barriers is positioned relatively near a radially outer end of a respective blade and approximately parallel to an end wall of the steam turbine. Moisture which accumulates on the radially outer end of the stationary blades is trapped between the end of the blade and the water barrier. Any water which attempts to flow over the top of the barrier is picked up by the steam flow and broken into small droplets while being rapidly accelerated. Water held behind the barrier and which flows off the trailing edge of the stationary blade only impacts a limited extent of the following rotating blade row. Water collection schemes may be utilized to collect the moisture trapped above the barrier and transfer the moisture through the turbine end wall to appropriate feedwater reheaters.

BRIEF DESCRIPTION OF THE DRAWINGS

For a better understanding of the present invention, reference may be had to the following detailed description taken in conjunction with the accompanying drawings in which:

FIG. 3 is a view similar to that of FIG. 1 but showing incorporation of a water barrier on the stationary blades in accordance with the present invention; and FIG. 4 is a radial view of a pair of adjacent stationary blades showing the arrangement of the water barrier of FIG. 3.

DETAILED DESCRIPTION OF THE INVENTION

Figure 1:
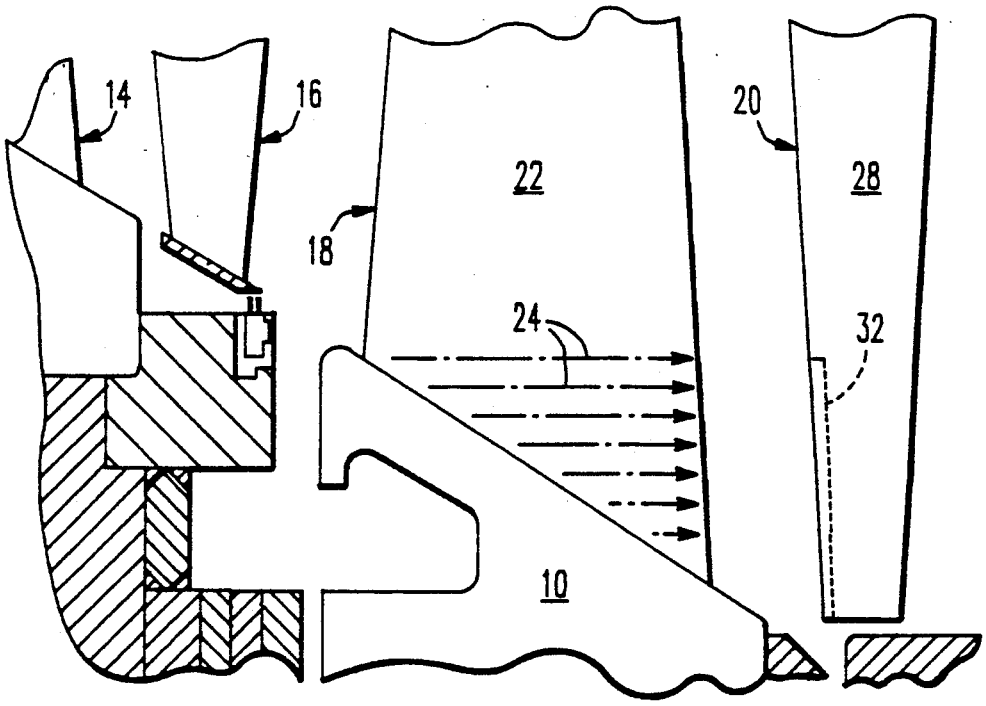
FIG. 1 is a simplified schematic representation of a portion of a steam turbine adjacent an end wall and illustrating a stationary blade row and an adjacent rotating blade row showing secondary flow characteristics for normal blade pitch.

FIG. 1 is a simplified, schematic representation of a portion of a steam turbine 10 adjacent an end wall 12 and illustrates a first stationary blade row 14, a second stationary blade row 18, and a pair of interspersed rotating blade rows 16 and 20. Considering a single cylinder or stationary blade 22 as seen from a suction side, the arrows 24 indicate the approximate extent in the radial direction of the secondary flow and the approximate axial orientation of the flow for a blade row properly pitched. The track of the arrows 24 has been determined empirically by observation of impurity deposits on the blades from moisture flowing over the surface. The radial extent of the moisture agrees with the studies discussed in the aforementioned ASME paper. As can be seen in the illustrative FIG. 1, the radial extent is approximately to an axial line originating at the most radially inward junction between blade 22 and end wall 12. The dotted line 26 on the leading edge of blade 28 of rotating row 20 indicates the area eroded by moisture droplets flowing off the trailing edge of stationary blade 22.

Figure 2:
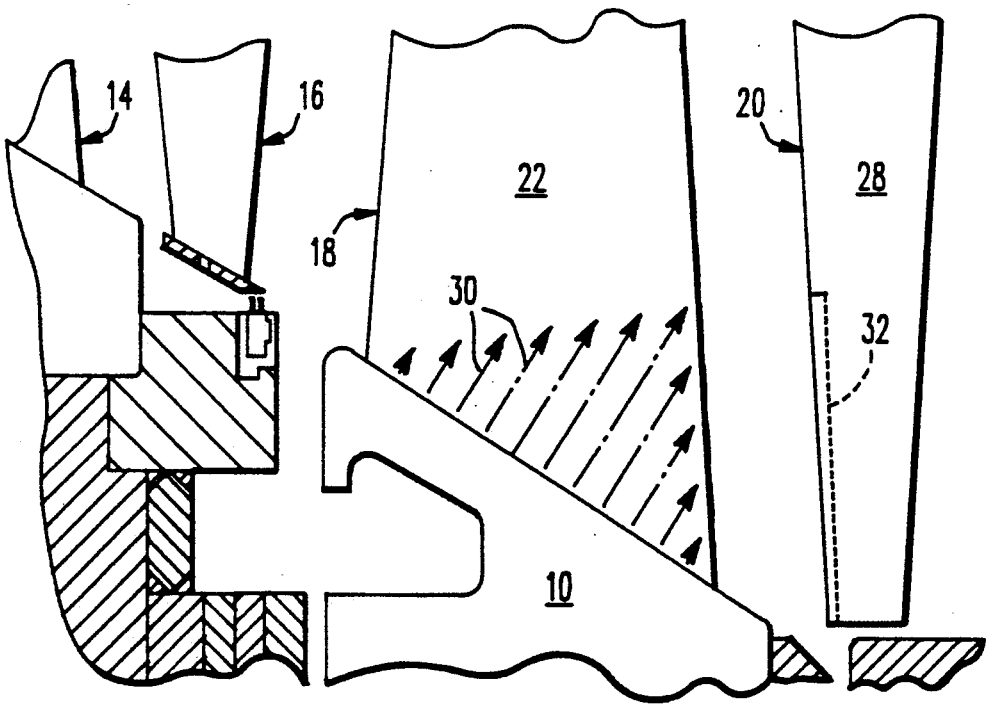
FIG. 2 is the same illustration as in FIG. 1 but illustrates secondary flow characteristics when the stationary blade row is overpitched.

Referring to FIG. 2, there is illustrated by arrows 30 the generally radially inward directed secondary flow moisture as a result of too high a pitch of the stationary blade row 16. In comparison to FIG. 1, the extent of the moisture distribution on the suction side of blade 22 is much more inward of an axial line from the junction of blade 22 and end wall 12. As shown by the dotted line 32 on blade 28, the area of erosion of blade 28 is also much greater. Accordingly, one method of reducing the extent of erosion of blade row 20 is to properly pitch the blade row 16. However, while this may reduce the radial extent of erosion somewhat, there still remains a 10–15% area of erosion on blades 28.

Referring to FIGS. 3 and 4, Applicants have found that erosion may be controlled to a greater extent by incorporating a barrier 34 on the suction side 36 of each stationary blade 22 of blade row 16. The barrier 34 comprises a relatively narrow strip which extends approximately parallel to the surface of end wall 12 and approximately over the full extent of the suction surface 36. The barrier 34 need be only thick enough to withstand the steam flow through the turbine and have a height above the suction surface 36 substantially less than the spacing or opening between adjacent blades 22. The barrier need only be a fraction of an inch above the blade surface so as to force any moisture flowing over the barrier into the steam flow where it can be torn loose from the barrier and broken into small droplets. Note that moisture flowing off the trailing edge of a blade is temporarily protected by the wake of the blade before being broken up and accelerated by steam flow. Thus, moisture from the trailing edge may be in larger drops and has a greater impact on the blades 28.

Preferably, the barriers 34 can be placed within two to four inches (51 to 102 mm) of the end wall on a blade having a length of forty inches (10–16 mm) or more so as to channel moisture and force it to stay near the tip of the stationary vane flow passage. Other techniques of water collection can then be used to collect the moisture and direct it to appropriate feedwater reheaters in a well known manner. The barriers 34 may be made integral with the blades 22 by forming the barriers as part of the airfoil or blade casting.

While the principles of the invention have now been made clear in an illustrative embodiment, it will become apparent to those skilled in the art that many modifications of the structures, arrangements, and components presented in the above illustrations may be made in the practice of the invention in order to develop alternative embodiments suitable to specific operating requirements without departing from the scope and principles of the invention as set forth in the claims which follow.

What is claimed is:

1. A steam turbine with reduced rotating blade edge erosion from moisture transported by secondary flow, the turbine including a plurality of rows of rotating blades interspersed with a plurality of rows of stationary blades, and further including a water barrier extending substantially across a suction side of each blade of at least one of the rows of stationary blades, each water barrier being positioned relatively near a radially outer end of a respective blade and substantially parallel to an adjacent end wall of the turbine.

2. The steam turbine of claim 1 wherein said barrier comprises a relatively narrow strip attached to the suction side of a blade, said strip having a height above the blade surface substantially less than the opening between adjacent blades in said at least one of the rows of stationary blades.

3. Apparatus for controlling the radially inner depth of penetration of moisture transported by secondary flow within a low pressure steam turbine having a plurality of rows of stationary blades interspersed among a plurality of rows of rotating blades, the apparatus comprising a barrier attached to and extending substantially across a suction side of each blade of at least one of the rows of stationary blades.

4. The apparatus of claim 3 wherein said barrier comprises a relatively narrow strip positioned relatively near a radially outer end of a respective stationary blade.

5. The apparatus of claim 4 wherein said strip extends substantially parallel to said radially outer end of said respective stationary blade.

6. The apparatus of claim 5 wherein each said strip has a height above a respective suction side of a blade substantially less than the spacing between adjacent blades in said at least one of the rows of stationary blades.

* * * * *